US009856436B2

(12) United States Patent
Hudson

(10) Patent No.: US 9,856,436 B2
(45) Date of Patent: Jan. 2, 2018

(54) LAUNDRY ADDITIVES FROM MODIFIED CRUDE PROTEIN SOURCES

(71) Applicant: Alice Hudson, Jupiter, FL (US)

(72) Inventor: Alice Hudson, Jupiter, FL (US)

( * ) Notice: Subject to any disclaimer, the term of this patent is extended or adjusted under 35 U.S.C. 154(b) by 0 days.

(21) Appl. No.: 14/121,665

(22) Filed: Oct. 6, 2014

(65) Prior Publication Data

US 2015/0105310 A1 Apr. 16, 2015

Related U.S. Application Data

(60) Provisional application No. 61/961,353, filed on Oct. 11, 2013.

(51) Int. Cl.

| | |
|---|---|
| ***C11D 3/382*** | (2006.01) |
| ***C11D 3/38*** | (2006.01) |
| ***C11D 1/12*** | (2006.01) |
| ***C11D 7/44*** | (2006.01) |

(52) U.S. Cl.

CPC ..... *C11D 3/382* (2013.01); *C11D 3/38* (2013.01)

(58) Field of Classification Search

CPC ..... C11D 1/12; C11D 11/0017; C11D 7/44; C11D 3/38; C11D 3/382

See application file for complete search history.

(56) References Cited

U.S. PATENT DOCUMENTS

| | | | | |
|---|---|---|---|---|
| 4,689,381 | A * | 8/1987 | Krinski | D21H 19/50 106/124.1 |
| 5,112,520 | A * | 5/1992 | Krinski | C11D 3/382 106/154.3 |
| 2002/0144951 | A1* | 10/2002 | Sarkar | C02F 1/56 210/730 |
| 2005/0008604 | A1* | 1/2005 | Schultz | A61K 8/645 424/70.14 |
| 2005/0025725 | A1* | 2/2005 | Schultz | A61K 8/645 424/59 |
| 2005/0166796 | A1* | 8/2005 | Sun | C09J 189/00 106/140.1 |
| 2011/0098384 | A1* | 4/2011 | Blount | C07G 1/00 524/35 |
| 2013/0085211 | A1* | 4/2013 | Baxter | C08L 61/06 524/10 |
| 2013/0139725 | A1* | 6/2013 | Verbeek | C08L 89/00 106/154.11 |

* cited by examiner

*Primary Examiner* — Charles Boyer

(57) ABSTRACT

Modified protein compositions that provide benefits in laundry products are produced by minimal processing of crude protein sources. Modifications include reaction with one or more of 1) cationic functional agents, 2) anionic functional agents, 3) proteolytic enzymes, 4) reducing agents and 5) oxidizing agents. They may be complexed with a surfactant to improve the separation from insoluble cellulosic carbohydrate materials in the crude protein sources, and to improve their dispersibility and effectiveness in laundry products. The resulting products may provide benefits of preventing soil redeposition, preventing dye transfer, soil repellency, and fabric wear reduction in laundry operations. The invention also encompasses the laundry products comprising the protein compositions.

13 Claims, No Drawings

LAUNDRY ADDITIVES FROM MODIFIED CRUDE PROTEIN SOURCES

This application claims priority to U.S. Provisional Patent Application No. 61/961,353 filed Oct. 11, 2013.

FIELD OF THE INVENTION

This invention relates to crude protein sources modified with minimum processing steps and waste generation to provide additives with benefits in laundry processes, and to laundry products comprising the additives.

BACKGROUND OF THE INVENTION

The use of renewable sources of raw materials for producing chemical materials for applications in wide ranging industrial and consumer products is important for a sustainable future. The principles of green chemistry, as put forth in the widely acknowledged book "Green Chemistry Theory and Practice" by Paul Anastas and John Warner include the minimizing of waste streams in chemical processes, and biodegradation or recycling of chemical materials at the end of the use cycle. The use of naturally derived biodegradable raw materials to produce additives for use in consumer products by processes that generate minimal waste streams supports sustainability and the principles of green chemistry.

The use of chemically modified protein materials in laundry products is known. U.S. Pat. No. 5,112,520 discloses isolated vegetable proteins modified with anionic or cationic functionality which are shown to have soil antiredeposition properties in laundry detergents. U.S. Pat. No. 5,073,292 discloses cationically charged modified proteins as enzyme stabilizers in laundry detergents. U.S. Pat. No. 5,207,941 discloses vinyl monomers grafted to isolated proteins as detergent ingredients to improve detergency and reduce greying. In a paper presented at CESIO Paris in June 2008 entitled "Use of Protein Based Surfactants in Homecare and Laundry Applications", authored by Alun Barnes, Trevor Blerase, and Harry Motson, a number of applications for cationically modified proteins in laundry products are disclosed. The modified proteins were added to fabric conditioners and provided fiber protection, strengthening of fibers, softening, anti-pilling and antistatic effects, and improved lubricity. They do not disclose the nature of the modification, but state that the proteins become "cationically charged", and therefore would be expected to be incompatible with detergents comprised of anionic components. U.S. Pat. No. 5,952,288 describes complexes of hydrolyzed proteins and anionic surfactants wherein the anionic surfactant is present at a weight excess over the protein, and wherein the hydrolyzed protein is described as a chemical linker in the formation of microemulsions. U.S. Pat. No. 7,399,495 discloses the addition of soy lecithin to powdered or particulate protein products to improve their dispersibility. US Patent Application 2002/0144951 discloses cationically modified soy protein and soy flour with cationic reagents in an excess amount such that the protein becomes positively charged for use as a coagulant in waste treatment.

It is known that surfactants and in particular sodium lauryl sulfate interact with proteins. See, for example, Vasilescu, et al, *Langmuir* 1999, 15, 2635-2643; Turro, N. et al, *Langmuir* 1995, 11, 2525-2533; Moore, P. et al, *Langmuir* 2003, 19, 1009-1016; and Deo, N. et al, *Langmuir* 2003, 19, 5083-5088. U.S. Pat. Nos. 4,028,317, 4,029,825 and 4,058,510 describe the use of sodium lauryl sulfate to "complex" the proteins in whey solutions such as cheese and soybean whey to separate the protein from the other whey components by precipitation at the isoelectric point.

The protein compositions used in the examples of the referenced technologies are typically prepared from various protein containing sources that have undergone processing steps to increase and modify the protein content. The processing steps for increasing the soy protein content of defatted soybean materials are described, for example, in "Soybeans, Chemistry, Production Processing, and Utilization", edited by L Johnson, P. White and R. Galloway. The starting material for the concentrated soy protein products described in this reference is typically defatted soy flakes, or alternatively soy meal or soy flour which are prepared by milling the defatted soy flakes after the extraction of the oil. The soy flakes or flours typically contain 56 to 59 percent protein on a moisture free basis.

Soy protein concentrate is typically produced by at least one ethanol or aqueous ethanol extraction at a ratio of at least 10 parts of solvent to 1 part of defatted soy flakes. The product is spray dried, and the solvent may be recovered. Alternatively the concentrate can be prepared by at least one acid leaching step with water at the isoelectric point of the protein, or about pH 4.5. This process is carried out at 10 to 20 parts by weight of water per part of defatted soy flakes. The separated protein is then neutralized and dried. The soy protein concentrates typically contain 65 to 72 percent protein on a moisture free basis. Thus the production of soy protein concentrate by known methods produces a waste stream of at least 10 parts of water or other solvent per part of defatted soy flakes, and from about 9 percent to about 23 percent of the weight of the starting soy flakes is contained in the waste streams.

Soy protein isolates are typically prepared by a multistep procedure that includes 1) solubilizing the protein in the flakes at a 1:10 to 1:20 solids:solvent ratio at pH 9-11, 2) centrifuging to remove the insoluble fiber, 3) precipitating the protein at pH 4.2 to 4.5 by acidifying, 4) centrifuging to separate the insoluble protein curd, 5) washing the curd with water and centrifuging again, 6) neutralizing the protein with sodium or calcium hydroxide, and spray drying the neutralized suspension. The soy protein isolates typically contain 90-92 percent protein on a moisture free basis. Thus the production of soy protein isolates by known methods produces a waste stream of at least 30 parts of water or other solvent per part of defatted soy flakes, and from about 34 percent to about 39 percent by weight of the starting soy flakes is contained in the waste streams.

Proteins from many animal and vegetable sources have been isolated, processed and/or derivatized and disclosed for use in laundry products. These include as examples, corn, wheat, barley, oats, cottonseed, sunflower seed, peanuts, rapeseed and canola, sesame, safflower, peas, beans, lentils, bacteria, fungi, yeasts, algae, casein, keratin, and collagen. Processing of the proteins from other sources will vary from that described above for soy proteins, but to obtain the proteins in concentrations used in previously disclosed detergent applications, processes similar in complexity to that described for soy protein are typically used. Isolation of protein from canola meal is described, for example, in "Canola Proteins for Human Consumption: Extraction, Profile, and Functional Properties" in Journal of Food Science 2010 Vol 76 No 1 pages 816-828.

The concentration and isolation of the protein fraction from the soy flakes or soy flour clearly involves large volumes of solvents and waste streams, and multiple processing steps. Processing of proteins from other sources varies with the source but also typically involves large volumes of low value waste streams, and multiple processing steps.

There is a need for laundry additives that are 1) biodegradable and biorenewable, 2) produced sustainably with minimum processing steps, solvent use and waste production, and 3) compatible with laundry products containing anionic surfactants.

It is therefore an object of the invention is to provide effective additives for laundry products based on biodegradable and renewable protein sources.

A further object of this invention is to minimize the processing steps and the resulting waste streams in the preparation of protein derived additives for laundry products.

A further object is to utilize minimally processed protein sources to provide more economical additives in the intended applications.

A further object is to provide modified proteins that are compatible with and readily incorporated into the laundry products to which they are added, by the provision of products with a net anionic charge.

A further object is the provision of laundry products comprising additives derived from crude protein sources.

SUMMARY OF THE INVENTION

This invention is to crude protein sources that are modified by methods described herein to provide benefits laundry products. In the compositions of the invention the crude protein sources are minimally processed such that greater than 70 percent by weight of crude protein source in contained in the final product, thus minimizing the byproduct and waste streams. The crude protein sources may be modified by reaction with one or more of 1) cationic functional agents, in addition levels such that the product retains a net anionic charge at alkaline pH values, 2) anionic functional agents, 3) proteolytic enzymes, 4) reducing agents and 5) oxidizing agents. Preferably they are complexed with a surfactant, and preferably an anionic surfactant to improve the separation from insoluble cellulosic carbohydrate materials in the crude protein sources, and to improve their dispersibility and effectiveness in laundry products. The modified proteins may prevent the redeposition of soils from the wash liquor that lead to greying of laundered materials. They may also prevent dye transfer from garment to garment in the wash. Additionally they may provide soil repellency to laundered fabrics. They may provide a lubricated surface on the fabric that decreases fabric abrasion and pilling.

The invention also encompasses methods of production of modified proteins from crude protein sources that are useful in laundry products. The production processes minimize processing steps and waste streams. In preferred embodiments, greater than about 70 percent of the crude protein source is present in the detergent additive, and less than about 10 parts by weight of water or other solvent per 1 part by weight of the crude protein source is used in the processing step. In a preferred embodiment the dispersibility of the protein in laundry products is improved and the separation from the insoluble cellulose fraction of the crude protein source is facilitated by the addition of a surfactant.

The invention also encompasses the provision of additives that can be readily incorporated into laundry products.

A further embodiment is the provision of laundry products comprising additives derived from crude protein sources.

DESCRIPTION OF THE PREFERRED EMBODIMENTS

Suitable crude protein sources may be any crude source that contain at least about 20 percent protein and preferably at least about 30 percent protein, more preferably at least 40 percent protein and most preferably at least about 50 percent protein. The sources preferably contain no materials that may interfere with the efficacy of the modified proteins of this invention or with the efficacy of other components in the laundry products. Suitable protein products may be derived from sources including but not limited to soy, corn, wheat, barley, oats, cottonseed, sunflower seed, peanuts, rapeseed and canola, sesame, safflower, peas, beans, lentils, castor beans, bacteria, fungi, yeasts, algae, casein, keratin, and collagen. Preferred sources include the protein containing byproducts of oil extraction processes, of which defatted soy flakes, soy meal and soy flour, defatted canola meal, cottonseed meal, extracted sunflower seeds, peanut meal, safflower meal, castor bean meal and flaxseed meal are examples. Because of their high protein content and ready availability, defatted soy flakes and the soy meal and soy flour derived from defatted soy flakes are especially preferred.

Defatted soy flakes, soy meal and soy flour suitable for use in this invention are coproducts from the extraction of oil from soy beans. They typically contain from about 52 to 54 percent protein, from about 0.5 to 1 percent lipid, from about 2.5 to 3.5 percent crude fiber, from about 5 to 6 percent ash, from about 30 to 32 percent carbohydrates, and from about 6 to 8 percent moisture.

The protein portion of the crude protein sources is preferably modified in its native state, without separating it from the remaining components of the defatted protein sources. This reduces the number and complexity of the processing steps and the consequent costs, reduces the usage of water and other processing chemicals, and reduces or eliminates byproducts and waste streams.

The modifications may include but are not limited to:

A. Addition of cationic reagents. Suitable cationic reagents may include epoxide, chlorohydrin or acrylate cationic monomers. Examples include glycidyl trimethylammonium chloride, 3-chloro-2-hydroxypropyl-trimethylammonium chloride, 4 chlorobutene trimethylammonium chloride, and cationic acrylate and acrylamide monomers such as methacrylamidopropyltrimethyl ammonium chloride, dimethylaminopropylmethacrylamide, isopropylaminopropyylmethacrylamide, and methacrylamidopropylhydroxyethyl dimethylammonium acetate. Preferred reagents are glycidyl trimethylammonium chloride (GMAC, available from Perstorp), and 3-chloro-2-hydroxypropyl-trimethylammonium chloride (Quat 188, available from Dow Chemical Co.). The molar equivalent of cationic modification is preferably less than the molar equivalent of anionic functionality of the proteins from the presence of anionic moieties including glutamic and aspartic acid residues in the protein. Soy protein at alkaline pH values has a combined carboxylate functionality of about 182 moles per 100 kg of protein, which is about 100 to 108 moles per 100 kg of soy flour. At pH values above about 6, the carboxyl moieties of these amino acids are negatively charged and the modified protein has a net negative charge. This is desirable for the compatibility of the modified proteins with laundry products which typically contain anionic surfactants. To assure that the modified product remains negatively charged at pH values above about 6, the molar amounts of cationic reagent added to the protein product is preferably less than the anionic functionality of the protein source. If soy flour is used the cationic reagent added per 100 kg of soy flour is preferably from about 10 to about 100 moles and more preferably from about 10 to about 75 moles and most preferably from about 20 to about 50 moles. Reactions with the preferred reagents GMAC and Quat 188 are preferably carried out at pH values of about 10 to 11 to optimize the reaction with the targeted amine functionality of the protein. The reaction temperature is preferably between about 40° C. and 80° C., and more preferably between about 50° C. and 60° C.

B. Addition of anionic reagents. The preferred reagents are carboxylic anhydrides and preferably anhydrides of di- or polycarboxylic acids. Examples of suitable anhydrides include but are not limited to maleic anhydride, succinic anhydride, phthalic anhydride, trimellitic anhydride, and itaconic anhydride. The anhydrides may be added in molar amounts based on 100 kg of protein containing material of from about 10 moles to about 300 moles, and preferably from about 50 moles to about 200 moles of anhydride to 100 kg of protein containing material. The anhydrides react with the lysine and other active hydrogen functionality on the protein and carbohydrate material in the crude protein source and provide additional anionic functionality. Reactions are carried out at pH values of at least about 8 and preferably at pH values of about 9 to 10.5. The reaction temperature is preferably between about 40° C. and 80° C., and more preferably between about 50° C. and 60° C.

C. Hydrolysis. To reduce the molecular weight and to provide enhanced functionality, the crude protein sources may be partially hydrolyzed by methods known in the art. Hydrolysis using acidic or basic conditions is known and may be useful in this invention. Preferably the proteins may be hydrolyzed using alkaline protease enzymes. Suitable methods are described in U.S. Pat. Nos. 7,332,192 and 4,100,024, incorporated herein by reference. Hydrolysis may be coupled with other modification methods such as the addition of cationic or anionic functional reagents, treatment with reducing or oxidizing agents, and separation with anionic surfactants.

D. Treatment with reducing agents. Reducing agents may be added to disrupt the disulfide bonds in the crude protein sources and improve the reactivity of the proteins with modifying agents. The reducing agents are preferably added prior to the reaction with cationic or anionic reagents. Suitable reducing agents include, but are not limited to, sodium sulfite, thioglycolic acids or thioglycolate salts, and sodium sulfide.

E. Treatment with oxidizing agents. Oxidizing agents may improve the color, odor, and dispersibility of the protein containing materials. They may also oxidize specific groups on the proteins to enhance the functionality. For example, sulfhydryl groups may be oxidized by hydrogen peroxide to sulfonate moieties. Suitable oxidizing agents include, but are not limited to, hydrogen peroxide, potassium persulfate, sodium perborate, and sodium percarbonate. Hydrogen peroxide is preferred. An oxidizing step may be carried out prior to or following the reaction by other modification methods. Oxidizing methods are described in U.S. Pat. No. 4,961,788, incorporated herein by reference.

Suitably the reactions are carried out in water dispersions. Typically the crude protein source is dispersed in water at ratios of about 10 to 25 parts by weight of protein material to about 90 to 75 parts by weight of water. The pH is adjusted to the preferred values for the desired reaction, and the temperature is adjusted to the preferred values for the reaction. The reaction is agitated by suitable means and the reagents are added as water solutions or as 100 percent active materials, in one addition or in multiple additions. The pH is preferably monitored and adjusted in the course of the reactions. The reaction times are suitably between 30 minutes and 4 hours.

At the completion of the reaction the reaction mixtures may be further processed by methods that minimize waste and byproducts. Methods include but are not limited to:

A. Drying. The reaction mixture may be dried by known methods including but not limited to spray drying, tray drying, and wiped film evaporation. The temperature of the drying operation is preferably below about 100° C. and more preferably below about 70° C. The dried materials which contain 100 percent of the starting crude protein sources and added reagents may be subjected to milling or grinding procedures to obtain materials suitable for incorporation into laundry products.

B. Centrifugation. The reaction mixture may be subjected to a centrifuging step to separate insoluble predominantly cellulosic materials. In general the insoluble materials do not interfere with the desired efficacy in laundry products but may be undesirable because they are insoluble in liquid laundry products. Centrifugation procedures are common, and one skilled in the art will be able to determine the optimum equipment and conditions for a given reaction mixture. Industrial centrifuges are reviewed by Ken Sutherland in Filtration+Separation, July/August 2005, incorporated herein by reference.

The supernatant fraction containing the modified protein may be dried by the methods described above, or may be added to laundry products as a liquid suspension or solution. The insoluble solid materials removed by the centrifuging step typically contain insoluble cellulosic carbohydrate materials with a minor protein component, and can be used in such applications as soil amendments or growing media. The separated insoluble materials are less than about 30 percent and preferably less than about 20 percent, and most preferably less than about 10 percent by weight of the crude protein source.

C. Separation at the isoelectric point. When the pH of the reaction mixture is adjusted to its isoelectric point, defined as the point at which the positive and negative charges on the protein are balanced, the protein is insoluble and precipitates. The optimum pH will depend on the source of the protein; for the preferred soy protein sources of this invention, the isoelectric point and the optimum pH is from about pH 4.2 to about pH 4.5. A suitable pH range is from about pH 4 to pH 5. The mixture at the pH of the isoelectric point of the protein may be centrifuged and the supernatant fraction containing soluble carbohydrates, salts, and other soluble components may be decanted and discarded or used for other applications. The modified protein containing precipitate, which typically contains greater than 70 percent by weight of the starting soy flour, may be dried as described above, or it may be neutralized and dried, or it may be neutralized and added to laundry products as a solution or suspension.

D. Solubilization with surfactants. A highly suitable method to separate the modified protein from the insoluble portions of the protein containing materials comprises adding a surfactant to the reaction mixture to enhance the solubility of the modified protein, followed by a centrifugation step to remove the insoluble components of the protein containing starting material. The surfactants are added to the reaction mixture at a level of from about 1 percent to about 50 percent of weight of the protein containing material. Preferred levels are from about 5 percent to about 25 percent of the protein containing material, and most preferred levels are from about 10 to about 20 percent of the protein containing material. The surfactants may be added to the protein suspensions prior to the addition of the modifying reagents or may be added after the reaction is completed. Surfactants may be anionic, nonionic, cationic or amphoteric. Anionic surfactants are preferred. Suitable surfactants are those that are commonly used in laundry detergents and include but are not limited to linear alcohol sulfates, methyl ester sulfonates, alkyl benzene sulfonates, alpha olefin sulfonates, and alcohol ether sulfates. Sodium lauryl sulfate and sodium lauryl ether sulfate are highly suitable. The addition of highly polar solvents such as glycerin at levels of from about 0.5 percent to about 100 percent on the weight of the protein containing material may enhance the separation. The solubilized protein containing product may be dried by the methods described above or may be added directly to the laundry products as a solution. The solubilized product comprises greater than about 70 percent by weight of the starting protein containing material, and preferably contains greater than 80 percent by weight of the starting protein containing material, and most preferably contains greater than about 90 percent by weight of the starting protein containing material.

A typical process for the production of an additive that may provide benefits of preventing soil redeposition, preventing dye transfer, and providing antisoiling benefits may include the steps of:

1. Dispersing about 15 to 20 parts by weight of soy flour in about 80 to 85 parts of water;
2. Warming the mixture to about 50 to 60° C. and adjusting the pH with an alkaline material, typically sodium hydroxide to about pH 10.5 to 11;
3. Adding from about 3 to about 12 parts by weight of a 30 percent active solution of sodium lauryl sulfate or other suitable surfactant;
4. Adding from about 1 to about 2 parts by weight of a 73 percent solution of GMAC in 1 to 4 additions over about 1 to 4 hours, keeping the pH between 10.5 and 11, and the temperature between about 50 and 60° C.;
5. Adjusting the pH to about 9.5 and separating the product containing soluble fraction and the cellulosic insoluble fraction by centrifuging or other suitable means;
6. Optionally adding from about 0.1 to about 1 parts of hydrogen peroxide to the soluble fraction holding at about 50 to 60° C. for about 30 minutes.
7. Optionally drying the product fraction by any suitable means.

The modified protein materials produced by the described processes are used in laundry applications preferably as additives in laundry products. The processes of this invention minimize coproduct generation such that at least about 70 percent by weight of the protein source is contained in the laundry product additive. In preferred processes at least about 80 percent by weight of the protein source is contained in the additive, and most preferably more than 90 percent by weight of the protein source is contained in the additive.

The modified protein materials may be incorporated into laundry products by methods known in the art. The dried modified protein materials may be added directly to powdered detergent in a dry mixing procedure, or the dried material may be dispersed into the crutcher mix prior to spray drying. The liquid suspensions of the modified soy protein materials may be sprayed onto the powdered detergents in a dry mixing procedure or may be added to the crutcher mix. The dried modified protein materials may be added to liquid detergents directly, or preferably by predispersing in water or surfactant solution before addition. The liquid suspensions of the modified protein materials may be added to liquid detergents directly. The modified protein materials solubilized with surfactants and separated from the insoluble carbohydrate components are particularly suitable for incorporation into liquid detergents.

The modified protein products of this invention can be used in other laundry products including but not limited to softeners, prespotters, and products for use as softener or antistatic agents in the dryer.

The modified protein products may be added to laundry products to provide a number of benefits. They may provide soil antiredeposition benefits over a broad range of soils, fabrics and laundry conditions. They may prevent the transfer of dyes from garment to garment in the laundry. They may provide a soil repellent surface for fabrics, particularly for oily soils. They may provide a lubricant effect on the fabric surface that reduces fabric wear and pilling.

Because of the chemical and consequent physical structure of the polymeric peptides constituting the protein, the modified protein products of this invention display both amphoteric and amphipathic properties. Their amphoteric properties, which results from the possession of both electrically positive and negative sites, and their amphipathic properties, which result from the intrinsic primary structure of the protein that provides both hydrophilic and hydrophobic amino acids and domains, show a broader spectrum of activity than current products available for applications in laundry products.

The invention also encompasses laundry products including but not limited to laundry detergents that comprise the modified protein products of the invention. The laundry products may be in in any form, including but not limited to powders, liquids, tablets, bars, pastes, gels, and pouches, or "pods". Typical laundry detergents are described in *Formulating Detergents and Personal Care Products* by Louis Ho Tan Tai, AOCS Press, 2000, incorporated herein by reference. Chapter 3 describes powders, bars, pastes and tablets; chapter 4 describes liquids including structured liquids in which particles are suspended.

Pouches or pods are generally described in U.S. Pat. No. 6,815,410 to Procter & Gamble, incorporated herein by reference. An example of a highly concentrated liquid detergent is described in US Patent Application 2013/0053298, to Method, incorporated herein by reference. The modified protein products of this invention can be added to the laundry products at levels of from about 0.1 percent to about 20 percent by weight of the laundry product composition, preferably from about 0.1 percent to about 10 percent and most preferably from about 0.2 percent to about 5 percent. The optimum level of the modified protein product in the laundry product will provide a level in the wash liquor that provides the desired benefit, and will depend on the use level of the laundry product in the wash liquor. The optimum level in the wash liquor will depend on the desired benefit, the composition of the laundry product and the level added to the wash liquor, and the washing conditions. Beneficial levels of the protein product in the wash liquor are typically between about 1 and about 500 ppm by weight.

The following examples further illustrate the invention. As used herein all parts or percentages are by weight of the entire composition unless otherwise indicated. The soy flour that was used in preparing the modified proteins in the examples was supplied by Applied Protein Systems, Crestwood, Ky. The particle size was more than 80% through 325 mesh, the protein content was 55 percent by Kjeldahl analysis, and it contained 8.2 percent moisture.

To demonstrate the solubilization of the modified soy protein, and its separation from the insoluble cellulosic carbohydrate containing material, the experiments in Examples 1, 2, and 3 were performed.

Example 1

A 1 liter flask equipped with an overhead stirrer and a water bath, was charged with 425 g of water, and 75 g of soy flour was added with stirring. 17 g of 2M sodium hydroxide was added to adjust the pH to 10.8. The mixture was heated to 50° C., and 2 g of 73 percent active glycidyl trimethylammonium chloride (GMAC) was added. The GMAC addition was repeated 2 more times at 1 hour intervals. The reaction was held at 50° C., and 2M sodium hydroxide addition was used to maintain the pH at 10.8. One hour after the final GMAC addition, 15% hydrochloric acid was used to adjust the pH to 9.5. 47 g of 33 percent sodium lauryl sulfate and 37.5 g of glycerin were added to the mixture. The mixture was mixed for 30 minutes more at 50° C. and then cooled to ambient temperature.

Example 2

A 1 liter flask equipped with an overhead stirrer and a water bath, was charged with 341 g of water, 47 g of 33 percent sodium lauryl sulfate 37.5 g of glycerin, and 75 g of soy flour was added with stirring. 30 g of 2M sodium hydroxide was added to adjust the pH to 10.8. The mixture was heated to 50° C., and 2 g of 73 percent active glycidyl trimethylammonium chloride (GMAC) was added. The GMAC addition was repeated 2 more times at 1 hour intervals. The reaction was held at 50° C., and 2M sodium hydroxide addition was used to maintain the pH at 10.8. One hour after the final GMAC addition, 15% hydrochloric acid was used to adjust the pH value to 9.5. The mixture was mixed for 30 minutes more at 50° C. and then cooled to ambient temperature.

Example 3

A 1 liter flask equipped with an overhead stirrer and a water bath, was charged with 425 g of water and 75 g of soy flour was added with stirring. 27 g of 2M sodium hydroxide was added to adjust the pH to 10.8. The mixture was heated to 50° C., and 2 g of 73 percent active glycidyl trimethylammonium chloride (GMAC) was added. The GMAC addition was repeated 2 more times at 1 hour intervals. The reaction was held at 50° C., and 2M sodium hydroxide addition was used to maintain the pH at 10.8. One hour after the final GMAC addition, 15% hydrochloric acid was used to adjust the pH to 9.5. The mixture was mixed for 30 minutes more at 50° C. and then cooled to ambient temperature.

To prepare solubilized protein suitable for inclusion in liquid laundry products, the insoluble carbohydrate materials were removed from the modified proteins from Examples 1, 2, and 3 by the following procedure.

100 g of each of the reaction mixtures from Examples 1, 2, and 3 were centrifuged at 2000 RPM providing a force of about 1000 G for 20 minutes. The supernatant was decanted, and an amount of water equal to the weight of the supernatant removed was added to the precipitate and stirred to a uniform suspension. This mixture was centrifuged at 2000 RPM for 10 minutes. The supernatant was decanted and an equal weight of water was added to the container, stirring to obtain a uniform suspension. This solution was centrifuged again at 2000 RPM for 10 minutes and the supernatant decanted. The three supernatant fractions were combined to obtain a protein rich solution. The dried precipitated material from Example 2 was analyzed by FTIR and was shown to be mostly cellulosic with a minor amount of protein.

The portion of the soy flour that was solubilized into the supernatant was determined by measuring the nonvolatile content of the combined supernatant fractions and of the precipitate, and allowing for the nonvolatile material added from the sodium lauryl sulfate, glycerin, and salts from pH adjustment. The values were:

| | Portion of the added soy flour in the supernatant |
|---|---|
| Example 1 | 70% |
| Example 2 | 86% |
| Example 3 | 56% |

This demonstrates that the addition of sodium lauryl sulfate and glycerin effectively solubilized the modified protein, and that adding them prior to the reaction with GMAC was more effective than adding them after the reaction.

The centrifuge separation was performed under laboratory conditions wherein the separations that can be achieved are considerably less efficient than in production equipment. The centrifuge step in these examples, which were performed at 2000 rpm generated a force approximately 1000 times the force of gravity (G). In typical production equipment forces as high as 10,000 G are readily attainable, and the separation achieved will be expected to be much improved.

The supernatant solutions from Examples 1 and 2 were mixed with 2 commercial liquid detergents at levels of 2 and 4% active soy flour material. The detergents remained clear and stable. On mixing the reaction mixture from Example 3 before the centrifuge separation step, with the liquid detergent, the insoluble material separated from the detergent-additive mixture as a flocky phase. These examples show that the insoluble material, which is mostly cellulosic carbohydrate in composition, can be separated in a procedure that produces a product soluble in liquid detergents and produces minimal waste materials; in Example 2, only 14 percent of the starting soy flour was discarded in the separated insoluble phase.

Example 4

A portion of the reaction mixture from Example 3 before centrifuging was tray dried at ambient temperature, and ground in a Waring Blender to a fine powder. It contained 100 percent of the added soy flour, with no generated waste.

Example 5

A modified soy protein product was prepared from soy flour reacted with a 65% active solution of 3-chloro-2-hydroxypropyltrimethylammonium chloride (Quat 188, from Dow Chemical Company).

800 g of water was charged to a 2 liter flask, and 182 g of soy flour was added and dispersed with stirring. 15.4 g of Quat 188 was added and the pH was adjusted to 10.8 with 18 g of 50 percent NaOH. The mixture was heated to 50° C. and held at 50 to 60° C. for 1 hour. 250 g was discharged, and after cooling the pH of the discharged material was brought to 4.6 with 25 g of 15 percent sulfuric acid to precipitate the protein (Sample 1). 11.59 g of Quat 188 was added to the remaining reaction mixture and the pH was adjusted to 10.8 with 6 g of 50 percent NaOH. The mixture was held at 50 to 55° C. for an additional hour and another 250 g portion was discharged and after cooling was brought to pH 4.5 with 29 g of 15 percent sulfuric acid (Sample 2). 7.72 g of Quat 188 and 13 g of 50 percent NaOH was added to the remaining reaction mixture in the flask and it was held at 50-55° C. for an additional hour. After cooling the pH was brought to 4.6 with 50 g of 15 percent sulfuric acid (Sample 3).

The acidified samples were diluted with 1 part of water to 2 parts of reaction mix, and allowed to stand at 4° C. for 72 hours. The supernatant solution was decanted and the precipitated protein was tray dried. The precipitated fraction was 74 percent of the added nonvolatile material in the mixture for the first sample, 82 percent of the added nonvolatile material in the second fraction, and 70 percent of the added nonvolatile material in the remainder fraction.

Example 6

The procedure of Example 3 was repeated, except that portions of the reaction mixture were removed and acidified according to the method in Example 5.

A titration method adapted from "Charge Determination of Proteins with Polyelectrolyte Titration" by Horn and. Heuck in *Journal of Biological Chemistry*, Vol. 258, No. 3, issue of February 10, pp. 1665-1670. 1983 was developed to measure the reactive cationic functionality of the protein materials. The titration was carried out in a 0.2 molar acetic acid solution to eliminate interference from the carboxylic functional groups of the proteins.

The procedure included the steps of

1. Preparing 1 percent suspensions of the samples by dispersing in water at pH 9 to 10 and heating for 30 minutes at 70-80° C.
2. Measuring 100 microliter samples of the 1 percent dispersions into test tubes and dispersing into 5 ml of 0.2 M acetic acid.
3. Adding 0.5 ml of 20 ppm toluidine blue indicator to the test tubes.
4. Titrating with 1 mM (based on monomer content) poly 2-acrylamido,2-methyl propane sulfonate, sodium salt (poly AMPS) in 50 microliter increments, mixing well and waiting at least 30 seconds between additions. The end point is the increment at which the solution permanently changes from blue to pink.
5. Calculating the positive charge on the test material from the amount of titrant and its molarity.

The materials from Examples 5 and 6 were titrated using the described procedure. The charge on the protein was compared to the amount of added quaternary reagent (Quat 188 in Example 5 and GMAC in Example 6) to determine the relative reactivity of the two reagents. The soy flour itself is cationically charged under the acidic conditions of the titration from the content of cationic amino acids lysine and arginine. The results are shown in Table 1.

TABLE 1

| | Reagent | Moles of reagent added/100 kg of soy flour | Moles of cationic charge titrated/100 kg of product |
|---|---|---|---|
| Soy flour | none | 0 | 35 |
| Ex 5 sample 1 | Quat 188 | 29 | 53 |
| Ex 5 sample 2 | Quat 188 | 58 | 58 |
| Ex 5 sample 3 | Quat 188 | 87 | 61 |
| Ex 6 sample 1 | GMAC | 19 | 57 |
| Ex 6 sample 2 | GMAC | 26 | 57 |
| Ex 6 sample 3 | GMAC | 36 | 63 |

It was shown that the GMAC reagent is a more efficient reagent than Quat 188. Using GMAC as the reagent also eliminates the production of an equal molar quantity of salt (sodium sulfate in these examples) per mole of reagent added when Quat 188 is used as the reactant.

Example 7

Soy flour was modified with maleic anhydride and with a combination of maleic anhydride and hydrogen peroxide to produce anionically modified products by the following procedure.

1800 g of water was heated to 50° C. and maintained at this temperature. 200 g of soy flour was added with stirring, and the pH was adjusted to 9 with NaOH. 11 g of maleic anhydride was added in 3 additions at 20 minute intervals. The pH was adjusted to 8 to 9.5 with NaOH throughout the reaction. After the third addition of maleic anhydride the reaction was stirred an additional 20 minutes, and one half of the mixture was discharged and tray dried (sample 1). 1 g of sodium silicate and 20 g of 30 percent hydrogen peroxide was added to the remainder and the mixture was stirred an additional 25 minutes. The mixture was tray dried (sample 2). The dried products contained 100 percent of the starting soy flour.

Example 8

Soy flour was modified with hydrogen peroxide to produce an anionically modified product by the following procedure.

900 g of water was heated to 50° C. and maintained at this temperature. 100 g of soy flour was added with stirring. 2 g of sodium silicate and 40 g of 30 percent hydrogen peroxide were added. The mixture was stirred for 40 minutes maintaining the pH at 8 with NaOH. The product was tray dried. The dried product contained 100 percent of the starting soy flour.

Example 9

Soy flour was modified with maleic anhydride, phthalic anhydride and hydrogen peroxide to produce an anionically modified product.

900 g of water was heated to 50° C. and maintained at this temperature. 100 g of soy flour was added with stirring. 1 g of sodium sulfite was added and the pH was adjusted to 9 with NaOH. 2.75 g of phthalic anhydride and 2 g of maleic anhydride were added and stirred for 20 minutes, maintaining the pH at 9 with NaOH throughout the reaction. 4 g more maleic anhydride were added in 2 equal additions at 20 minute intervals, and after completing the additions the mixture was mixed for 20 minutes. 1 g of sodium silicate and 20 g of 30 percent hydrogen peroxide were added and the mixture was stirred for 20 minutes. The mixture was tray dried. The dried product contained 100 percent of the starting soy flour.

Example 10

Soy flour was modified by partially hydrolyzing the protein with the proteolytic enzyme Alcalase and reacting the hydrolyzed protein with Quat 188 by the following procedure.

22.7 kg of water were heated to 65° C. and 12 g of Alcalase enzyme was added and dispersed. 4.8 kg of soy flour were added with agitation. The reaction was held at 63° C. and the pH was maintained at 7.5 to 8 with sodium carbonate for 45 minutes. 12 g more alcalase was added and the reaction continued for 45 minutes longer. The pH was adjusted to 10 with sodium carbonate and 409 g of Quat 188 were added. The temperature was maintained at 52° C. and the pH was maintained above 9 with sodium carbonate for 2 hours, after which 144 g of sodium sulfite was added and the mixture was tray dried. The dried product contained 100 percent of the starting soy flour.

Example 11

To show that the cationically modified soy flours of Example 5 improved the soil repellency of fabrics when they were added to the wash liquor in laundry conditions, the following tests were conducted.

Samples 1, 2, and 3 from Example 5 were resuspended at 1% in water, the pH was adjusted to 9-10 and the mixtures were stirred at 70° C. for 30 minutes until uniformly dispersed. These were used at 20 ppm modified soy flour in the wash liquor. A commercial soda ash based household detergent was used at its recommended use level of 0.68 g/l. Results with the modified soy flours were compared with the unmodified soy flour and with commercially available soil repellent polymers.

Ten 4"×4" cotton percale swatches were washed in a laboratory Tergotometer for 10 minutes at 38° C. in tap water with the detergent-protein levels noted, for 5 wash cycles, rinsing and air drying between the cycles. 5 of the swatches were soiled with used cooking oil dyed with Solvent Red 27 at a level of 20 percent by weight of the swatch. After standing overnight the reflectance of the soiled swatches was determined with a Gardner Colorflex Reflectometer. The soiled swatches were washed again under the same conditions, and air dried. The reflectance was measured again, and the differences in the reflectance values before and after washing were determined. Higher numbers indicate more soil removed. The results are shown in Table 2.

TABLE 2

| Additive | Soil | Change in Reflectance |
|---|---|---|
| Example 5 Sample 1 | Used Frying Oil | 25.0 |
| Example 5 Sample 2 | Used Frying Oil | 27.5 |
| Example 5 Sample 3 | Used Frying Oil | 27.1 |
| Unmodified soy flour | Used Frying Oil | 23.5 |
| Commercial product 1 | Used Frying Oil | 23.3 |
| Commercial product 2 | Used Frying Oil | 21.9 |

This demonstrates that the cationically modified soy flour has soil repellent properties comparable to or better than commercially available polymers, and that the cationic modification improves the performance over the unmodified soy flour.

Example 12

The experiment of Example 11 was repeated with the cationically modified soy flour of Example 5, Sample 2, and swatches were removed and evaluated for soil repellency after each of the five cycles. The results are shown in Table 3.

TABLE 3

| Additive | Soil | Cycle | Change in Reflectance |
|---|---|---|---|
| None | Used Frying Oil | 1 | 24.0 |
| | | 3 | 24.3 |
| | | 5 | 26.0 |
| Example 5 Sample 2 | Used Frying Oil | 1 | 24.8 |
| | | 2 | 25.6 |
| | | 3 | 28.8 |
| | | 4 | 30.4 |
| | | 5 | 29.5 |

Example 13

To show that the modified soy flours of Example 4, Example 7 (Samples 1 and 2), Example 8, and Example 9 effectively prevent the redeposition of soil in the laundry, the following tests were performed. The modified soy flour products were dispersed at 1 percent by weight in water as described in Example 11, prior to addition to the wash liquor. The performance was compared with that of a commercially available polymer.

The conditions were:

Tergitometer at 80 RPM, 1 liter of 150 ppm hard water, 2:1 Ca:Mg at 38° C.

44"×4" scoured cotton percale swatches and 44"×4" scoured cotton/polyester percale swatches per bucket 0.73 g of a commercially available concentrated liquid laundry detergent Modified soy proteins were added at 10, 20 and 40 ppm to the wash liquor 10 minute wash cycle and 5 minute rinse cycle, air dry The soil was carbon black pigment prepared as a 5 percent dispersion in water and added at 25 ppm to the tergitometer bucket after the detergent, additive and swatches.

The reflectance of the scoured swatches was determined before the wash, and again after swatches were dried. The difference between the reflectance values was obtained. A smaller change in reflectance indicates less soil redeposited. The results are shown in Table 4. The results shows that both the cationically modified and the anionically modified soy flour effectively prevent soil redeposition in the laundry.

TABLE 4

| Additive | Level | Fabric | Change in Reflectance |
|---|---|---|---|
| Example 4 | 10 ppm | Cotton | 6.2 |
| | 20 ppm | | 5.6 |
| | 40 ppm | | 4.6 |
| Example 7 Sample 1 | 10 ppm | Cotton | 6.2 |
| | 20 ppm | | 5.8 |
| | 40 ppm | | 4.2 |
| Example 7 | 10 ppm | Cotton | 6.6 |

TABLE 4-continued

| Additive | Level | Fabric | Change in Reflectance |
|---|---|---|---|
| Sample 2 | 20 ppm | | 6.5 |
| | 40 ppm | | 4.7 |
| Example 8 | 10 ppm | Cotton | 6.4 |
| | 20 ppm | | 6.0 |
| | 40 ppm | | 5.7 |
| Example 9 | 10 ppm | Cotton | 7.2 |
| | 20 ppm | | 6.6 |
| | 40 ppm | | 4.7 |
| Commercial polymer | 10 ppm | Cotton | 7.7 |
| | 20 ppm | | 5.2 |
| | 40 ppm | | 5.0 |
| None | | Cotton | 8.8 |
| Example 4 | 10 ppm | Cotton/polyester | 6.4 |
| | 20 ppm | | 5.7 |
| | 40 ppm | | 4.2 |
| Example 7 Sample 1 | 10 ppm | Cotton/polyester | 3.6 |
| | 20 ppm | | 1.6 |
| | 40 ppm | | 0.7 |
| Example 7 Sample 2 | 10 ppm | Cotton/polyester | 4.6 |
| | 20 ppm | | 6.5 |
| | 40 ppm | | 4.9 |
| Example 8 | 10 ppm | Cotton/polyester | 7.2 |
| | 20 ppm | | 6.5 |
| | 40 ppm | | 5.9 |
| Example 9 | 10 ppm | Cotton/polyester | 8.2 |
| | 20 ppm | | 6.8 |
| | 40 ppm | | 5.2 |
| Commercial polymer | 10 ppm | Cotton/polyester | 8.5 |
| | 20 ppm | | 7.2 |
| | 40 ppm | | 6.0 |
| None | | Cotton/polyester | 11.0 |

Example 14

To show that the cationically modified soy flours solubilized by the methods of Examples 1 and 2 effectively prevent the redeposition of soil in the laundry, the following tests were performed. The solutions of the modified products were added to a commercially available superconcentrated detergent at a level of 4 percent by weight. The detergent was added to the wash liquor at its recommended use level of 0.37 g/liter. The results were compared to the product of Example 4, which is the cationically modified soy flour not solubilized, dispersed by the method of Example 11.

The conditions were:

Tergitometer at 80 RPM, 1 liter of 150 ppm hard water, 2:1 Ca:Mg at 38° C.

44"×4" scoured cotton percale swatches and 44"×4" scoured cotton/polyester percale swatches per bucket 20 minute wash cycle and 5 minute rinse cycle, air dry The soil was carbon black pigment prepared as a 5 percent dispersion in water and added at 25 ppm to the tergitometer bucket after the detergent, additive and swatches.

The results are shown in Table 5. Lower values indicate that less of the soil deposited on the fabric. The results show that the solubilized products of Examples 1 and 2 are highly effective at preventing soil redeposition in the laundry.

TABLE 5

| Additive | Fabric | Change in reflectance |
|---|---|---|
| Example 1 | Cotton | 1.5 |
| Example 2 | Cotton | 1.7 |
| Example 4 | Cotton | 4.0 |
| None | Cotton | 4.1 |
| Example 1 | Cotton/polyester | 9.8 |

TABLE 5-continued

| Additive | Fabric | Change in reflectance |
|---|---|---|
| Example 2 | Cotton/polyester | 10.3 |
| Example 4 | Cotton/polyester | 11.9 |
| None | Cotton/polyester | 14.3 |

Example 15

The compositions of the previous Examples may be added to laundry products to provide levels of 10 to 100 ppm in the wash liquor to reduce fabric wear and lint production, particularly in high efficiency washing machines and under industrial laundry conditions.

To show the solubilization of the modified soy protein by anionic surfactants and its efficient separation from the insoluble carbohydrate material in the soy flour, the experiments in Examples 16-24 were performed.

15 g of soy flour, 4 ml of 2 N NaOH, the additives shown in Table 6, and water to 100 g total weight were mixed to a uniform dispersion in stoppered 250 ml Erlenmeyer flasks. The flasks were secured to the platform of an orbital mixer in an oven at 50° C. At times 0, 1 hour and 2 hours, 0.41 g of a 73 percent active solution of GMAC and 0.67 g of 2 N NaOH were added. After 3 hours the pH values of the mixtures were adjusted to 9.5 with a 15 percent solution of HCl. The reaction mixtures were centrifuged as described previously, and the nonvolatile content of the supernatant and the precipitate were determined. The addition levels of the surfactants and glycerin and the results are shown in Table 6. The results show that even with the separation that can be achieved under laboratory conditions it is possible to significantly improve the recovery of the protein by the addition of surfactants and the solvent glycerin.

TABLE 6

| | Surfactant, % of soy flour | Glycerin, % of soy flour | % of added soy flour recovered in the supernatant | % of added soy flour in the precipitate |
|---|---|---|---|---|
| Ex. 16 | 5 Na lauryl sulfate | 0 | 85.0 | 15.0 |
| Ex. 17 | 20 Na lauryl sulfate | 0 | 85.7 | 14.3 |
| Ex. 18 | 35 Na lauryl sulfate | 0 | 89.7 | 10.3 |
| Ex. 19 | 50 Na lauryl sulfate | 0 | 94.7 | 5.3 |
| Ex. 20 | 20 Na lauryl sulfate | 5 | 90.8 | 9.2 |
| Ex. 21 | 20 Na lauryl sulfate | 20 | 90.5 | 9.5 |
| Ex. 22 | 20 Na lauryl sulfate | 50 | 93.9 | 6.1 |
| Ex. 23 | 20 Na lauryl ether sulfate | 0 | 87.8 | 12.2 |
| Ex. 24 | None | | 79.6 | 20.4 |

Example 25

The procedure of Example 17 was repeated. After the supernatant fraction was separated it was reacted with 2 percent active hydrogen peroxide on the weight of the soy flour for 30 minutes at 50° C. The compositions of Examples 17 and 25 were added to a commercial consumer liquid laundry detergent at a level of 2 percent active, and evaluated for effects on soil redeposition under the conditions described in Example 13. The soil was dispersed Barnard clay, which has a high content of iron oxide and manganese oxide and is dark in color. The results are shown in Table 7. Lower values indicate less soil redeposited. The soy flour derivatives are shown to be effective in preventing soil redeposition; the oxidized product appears to be very effective on clay.

TABLE 7

| Additive | Fabric | Change in Reflectance |
|---|---|---|
| Example 17 | Cotton | 11.7 |
| Example 25 | Cotton | 11.3 |
| None | Cotton | 14.3 |
| Example 17 | Durable Press | 8.9 |
| Example 25 | Durable Press | 8.2 |
| None | Durable Press | 12.6 |

The invention can be embodied in other forms without departing from the spirit or essential attributes thereof. The appended Claims set forth the scope of the protection sought.

The invention claimed is:

1. A method of producing a laundry additive, said laundry additive comprising a crude protein composition wherein the crude protein composition derives from one or more bio-based crude protein sources, said method comprising:

a. the provision of a crude protein source in its native state, said crude protein source comprising protein and non-protein components, the protein component being both amphoteric and amphipathic, and the non-protein components consisting of water soluble and water insoluble components, b. dispersing the crude protein source in water, c. modifying the crude protein source by i. reaction with a cationizing reagent, or ii. reaction with an anionizing reagent, or iii. enzyme hydrolysis, or iv. reaction with an oxidizing agent, or v. reaction with a reducing agent or by combinations thereof, d. adding from about 0.05 to about 0.5 parts by weight of a surfactant per 1 part by weight of the crude protein source, and e. removing an insoluble fraction comprising non-protein components from the reaction mixture, said insoluble fraction comprising less than about 30 percent by weight of the crude protein source, wherein the laundry additive contains the water soluble non-protein components of the crude protein source.

2. The method of claim 1 wherein the surfactant is anionic.

3. The method of claim 1 wherein the surfactant is sodium lauryl sulfate.

4. The method of claim 1 wherein i. the crude protein source is selected from the group consisting of defatted soy flakes, defatted soy flour and defatted soy meal, containing from about 50 to about 60 percent protein by weight and wherein the non-protein components comprise carbohydrates.

5. The method of claim 4 further comprising:

d. adding from about 0.05 to about 0.5 parts by weight of an anionic surfactant per 1 part by weight of the crude protein source* and e. removing from about 5 to about 15 percent by weight based on the weight of the crude protein source of a water insoluble non-protein fraction comprising non-protein components.

6. The method of claim 4 wherein the crude protein source is modified by at least reaction with a cationizing reagent.

7. The method of claim 6 wherein the cationic functionality of the laundry additive produced is between about 50 and about 90 moles of cation per 100 kilograms of the laundry additive at pH 2.

8. The method of claim 1 wherein the crude protein source is modified by at least reaction with an anionizing agent.

9. The method of claim 1 wherein i. the crude protein source is selected from the group consisting of defatted soy flakes, defatted soy flour and defatted soy meal, containing from about 50 to about 60 percent protein by weight and wherein the non-protein components comprise carbohydrates; and ii. wherein the method further comprises adding from about 0.05 to about 0.5 parts by weight of an anionic surfactant per 1 part by weight of the crude protein source, and iii. wherein the crude protein source is modified by at least reaction with an anionizing reagent; and iv. wherein from about 5 to about 15 percent by weight based on the weight of the crude protein source of a water insoluble fraction comprising non-protein components is removed from the anionically modified laundry additive.

10. A laundry additive produced by the method of claim 9.

11. The laundry additive produced by the method of claim 9 wherein the water is removed and the laundry additive is a powder.

12. The method of claim 1 wherein i. the crude protein source is selected from the group consisting of defatted soy flakes, defatted soy flour and defatted soy meal, containing from about 50 to about 60 percent protein by weight and wherein the non-protein components comprise carbohydrates; and ii. wherein the method further comprises adding from about 0.05 to about 0.5 parts by weight of an anionic surfactant per 1 part by weight of the crude protein source, and iii. wherein the crude protein source is modified by at least reaction with a cationizing reagent; and iv. wherein from about 5 to about 15 percent by weight based on the weight of the crude protein source of a water insoluble fraction comprising non-protein components is removed from the cationically modified laundry additive.

13. A laundry additive produced by the method of claim 12.

* * * * *